United States Patent [19]

Holtkamp, Jr.

[11] Patent Number: 5,038,930

[45] Date of Patent: Aug. 13, 1991

[54] FLOWER GREETING CARD

[76] Inventor: Reinhold Holtkamp, Jr., 1501 Lischey Ave., Nashville, Tenn. 37207

[21] Appl. No.: 581,384

[22] Filed: Sep. 12, 1990

[51] Int. Cl.[5] ..... B65D 85/52

[52] U.S. Cl. ..... 206/232; 206/423; 229/115; 229/162

[58] Field of Search ..... 206/45.31, 45.33, 45.34, 206/232, 423, 459; 229/115, 155, 156, 162

[56] References Cited

U.S. PATENT DOCUMENTS

| | | | |
|---|---|---|---|
| 1,987,081 | 1/1935 | Scott | 206/459 |
| 2,736,138 | 2/1956 | Buttery | 206/423 |
| 2,799,391 | 7/1957 | Eisner | 206/232 |
| 3,058.585 | 10/1962 | Budd | 206/423 |
| 3,684,084 | 8/1972 | | 206/45.31 |
| 3,768,720 | 10/1973 | Bundy | 229/156 |
| 4,700,831 | 10/1987 | Kassai | 206/232 |
| 4,828,105 | 9/1989 | Silengo et al. | 206/232 |
| 4,840,275 | 6/1989 | Faiola et al. | 206/459 |
| 4,915,224 | 4/1990 | Wulf et al. | 206/45.31 |
| 4,917,240 | 4/1990 | Roberts et al. | 206/232 |

*Primary Examiner*—Jimmy G. Foster
*Attorney, Agent, or Firm*—Foley & Lardner

[57] ABSTRACT

A greeting card assembly comprised of a plurality of transparent side walls and a transparent back panel, all of which are integrally formed or connected. A greeting card is adapted to be folded over the back panel so as to be visible when viewed from the front of the assembly, with the greeting card being hinged at one end so that it can be opened away from the back panel. The back panel is formed with a hinged panel which permits access to the interior of the assembly. A potted plant and a supporting water container can be inserted through such opening, with a protective sleeve extending upwardly from the pot and around the foliage and flowers of the plant. The upper edge of the sleeve is retained in position to prevent vertical upward movement of the pot, container, and sleeve. The entire assembly provides not only an attractive display of the plant, but also provides a greeting card visible through the transparent panels, with the card being unfolded for reviewing more intimate greetings or messages.

13 Claims, 5 Drawing Sheets

FLOWER GREETING CARD

BACKGROUND OF THE INVENTION

The present invention relates as indicated to a flower greeting card, and more particularly to the novel combination of a greeting card and an attractively packaged, preferably flowering, plant.

The basic idea of giving a plant in some form, for example, a potted flowering plant, together with a greeting card appropriate for the occasion is of course well known. The card, whether by itself or in an envelope, is normally laid loosely within the plant, attached to a card holder, taped to the pot, or associated with the plant in other appropriate fashions. A typical card holder comprises a metal or plastic member which can be inserted into the growing media and which is provided at its top with means for receiving and holding the appropriate card or message. This arrangement is particularly common in conjunction with plants and flowering material delivered to patients in hospitals. In arrangements of this type, the card is normally quite small, providing room only for a very short message and an identification of the giver.

To the best of applicant's knowledge, no one has previously attempted to combine the features of a normal size greeting card with an attractively displayed plant, wherein the plant is self-contained and can be removed from the display, and wherein the card is similarly self-contained and can likewise be removed or detached from the display. There has been a great need for a product of this type which advantageously combines the desirable aspects of greeting cards with the beauty and appropriateness of plant gifts.

SUMMARY OF THE INVENTION

It is accordingly an object of the present invention to provide a novel assembly in which a flowering plant and greeting card are combined in a unique manner.

It is a further object of the invention to provide such a combination wherein the plant, preferably in the form of a miniaturized potted plant, can be supplied either with the assembly supporting the greeting card, or supplied separately and combined with the assembly by the retailer. The plant preferably comprises a miniaturized plant in a relatively small pot (for example, 1"-2"), which is adapted to be received and supported by a self-watering container. To reduce the care and attention the plant would otherwise need prior to sale, the container for the plant preferably comprises a water reservoir from which the plant can be watered by means of capillary action.

More specifically, the assembly comprises transparent side walls and a back panel, with the back panel being formed with a hinged panel which can be opened to permit access to the interior of the assembly for positioning the potted plant in or removing the plant from the assembly. The plant and greeting card assembly can be shipped separately, the water supply replenished by the retailer, and the potted plant and container then inserted within the assembled greeting card for attractive display. The plant is retained within the greeting card assembly so as to prevent vertical movement of the plant, thereby providing stability to the assembly during handling.

A further aspect of the invention is in the novel characteristics of the greeting card. The card is preferably designed to present a greeting or other appropriate message on the face of the card adjacent to the back panel when the greeting card is folded and removably secured to the assembly. In this manner, the nature of the greeting, for example, a birthday greeting or a get well greeting, will be readily visible from the front of the assembly. When the card is unfolded and moved away from the back panel of the assembly, it opens up in much the same manner as a typical greeting card to expose a printed message and provide room for writing a personal greeting. Thereafter, the card can be refolded and removably secured to the assembly prior to giving to the recipient.

A further object of the present invention is the unique construction of the assembly and the manner in which the card can be secured thereto and retained thereby. In the preferred embodiment, transparent side walls and a back panel are provided, with two side walls being preferred and illustrated in the application drawings. A generally triangular shaped assembly is thus provided. The side walls are integrally secured or connected to the back panel, with the greeting card in turn being secured to the back panel or an adjoining said wall. The side walls and back panels are formed with bottom and top tabs which, when folded, provide a bottom wall for receiving the plant, and a top wall which is releasably closed but which can be opened if necessary to obtain access to the interior of the assembly from the top thereof. All of the various assembly steps can be performed quickly and easily, and, when assembled, the potted plant can be quickly positioned in or removed from the interior of the assembly as above described.

More specifically, the invention in its basic aspects comprises an assembly adapted to receive and support a decorative plant comprising transparent side walls and a transparent back wall having a hinged panel, a greeting card secured to one of the side walls and being adapted, when folded, to be positioned behind the back panel and viewable therethrough from the front of the assembly, bottom flanges extending from the side walls and back panel which, when releasably interconnected, form a bottom wall, and top flanges extending from the side walls of the back panel to form, when releasably interengaged, a top wall. Access to the interior of the assembly is provided by the hinged panel of the back panel which, when the greeting card is unfolded, can be swung outwardly to provide an opening through which the plant and its container and a surrounding sleeve can be positioned within the assembly, resting on the bottom wall. The hinged panel can then be closed and the greeting card re-folded and secured in such position. By virtue of the hinged panel, the plant and container can be removed for necessary watering, and the ultimate recipient is able to remove not only the plant, but also the greeting card if it is desired to keep the same.

These and other objects of the invention will be apparent as the description proceeds in particular reference to the application drawings.

BRIEF DESCRIPTION OF THE DRAWINGS

The invention will be better understood through reference to the application drawings, in which.

DETAILED DESCRIPTION OF THE PREFERRED EMBODIMENTS

Figure 2:
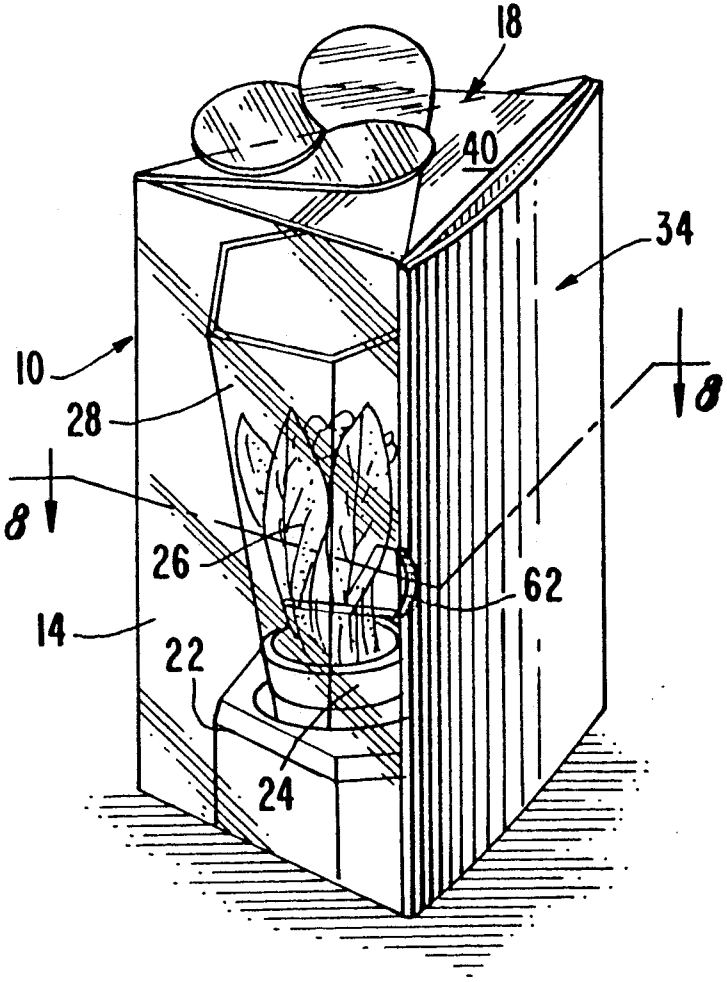
FIG. 2 is a perspective view similar to FIG. 1, only taken from the opposite side to more clearly show the attachment of the greeting card to the outer container.
Figure 1:
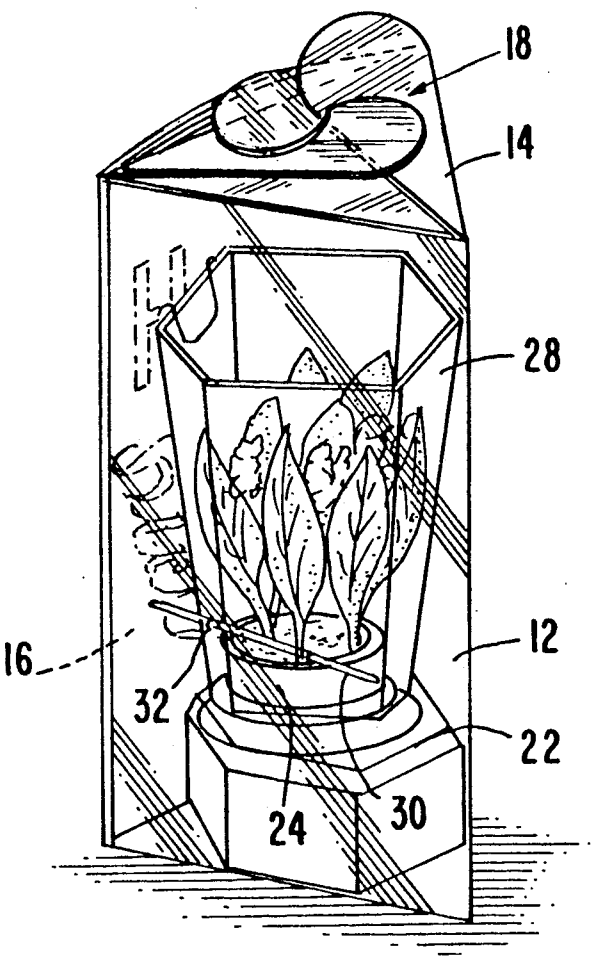
FIG. 1 is a top front perspective view of the flower greeting card constructed in accordance with the invention, with a plant and a container therefor being illustrated within an outer container, and the entire assembly ready for sale.

Referring now in more detail to the application drawings, wherein like parts are indicated by like reference numerals, the complete and assembled flower greeting card constructed in accordance with the invention is illustrated in opposite perspective views in FIGS. 1 and 2. The assembly includes a transparent outer container generally indicated at 10 comprised of side walls 12, 14 and 16 which, when assembled, are generally triangular in cross-section in the form shown, with the wall 16 forming the back panel of the assembly. The outer container can be closed at the top by a top wall generally indicated at 18 and at its bottom by a bottom wall generally indicated at 20 (FIG. 7), the details of which will be described in more detail below.

Positioned within the container and resting on the bottom wall 20 is a self-watering container 22 adapted to support the top flange of a pot 24 which contains a plant 26. Both the plant and pot are miniaturized in the form shown, and although no invention resides in the particular type of plant material, the invention is particularly adaptable to miniaturized African Violet plants.

Figure 3:
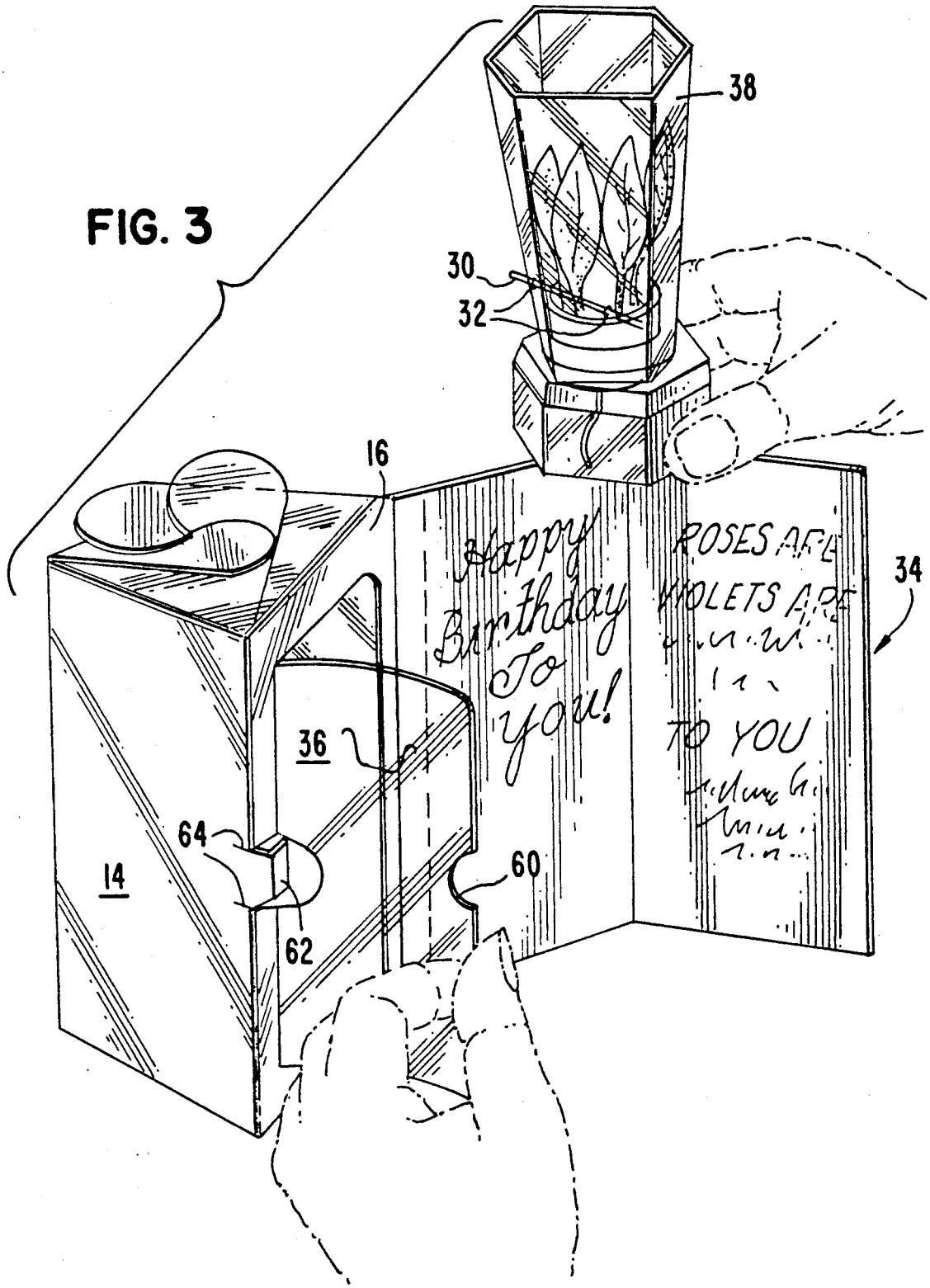
FIG. 3 is a perspective, partially exploded view showing the greeting card in an open position and the back wall of the outer enclosure opened to permit the plant and container to be removed.

In order to protect the leaves of the plant during assembly and shipping, a transparent sleeve 28 is positioned around the upwardly drawn leaves of the plant. As shown in FIG. 3, a pin 30 extends through openings commonly designated at 32 formed in the individual walls of the sleeve to prevent the pot and thus the plant from moving vertically upwardly relative to the sleeve thereby precluding damage to the plant during handling prior to sale.

The container 22 and pot 24 per se form no part of the present invention, both being described in more detail in my co-pending application Ser. No. 281,622, the details of which are incorporated herein by reference. It will be understood that other forms of containers and plant pots could also be used in accordance with the concepts of the invention.

A greeting card generally indicated 34 is secured to the side wall 12 of the assembly, and is shown in FIGS. 1 and 2 in a fully closed position. The front of the greeting card is visible through the transparent walls 12, 14 and 16, as is the plant. The card can be opened as will be presently described to permit viewing of the message or greeting on the inside of the card, in the same manner as a normal greeting card.

FIG. 3 illustrates the card being opened so as to permit the panel 36 formed from and hinged to the back wall 16 to be swung to an open position to gain access to the container and plant, with the latter being shown removed from the container. A simple tab connection maintains the card in a closed position, as will be presently described, and when the card is open, the panel 36 is fully exposed for hinged movement as described. It will be noted that the container and plant can be removed, and the card opened, without opening either the top or bottom of the outer container 10, thereby permitting the plant and container to be repositioned within the outer container and the card refolded. This permits further transportation and/or handling of the assembly while the outer container remains intact.

Figure 4:
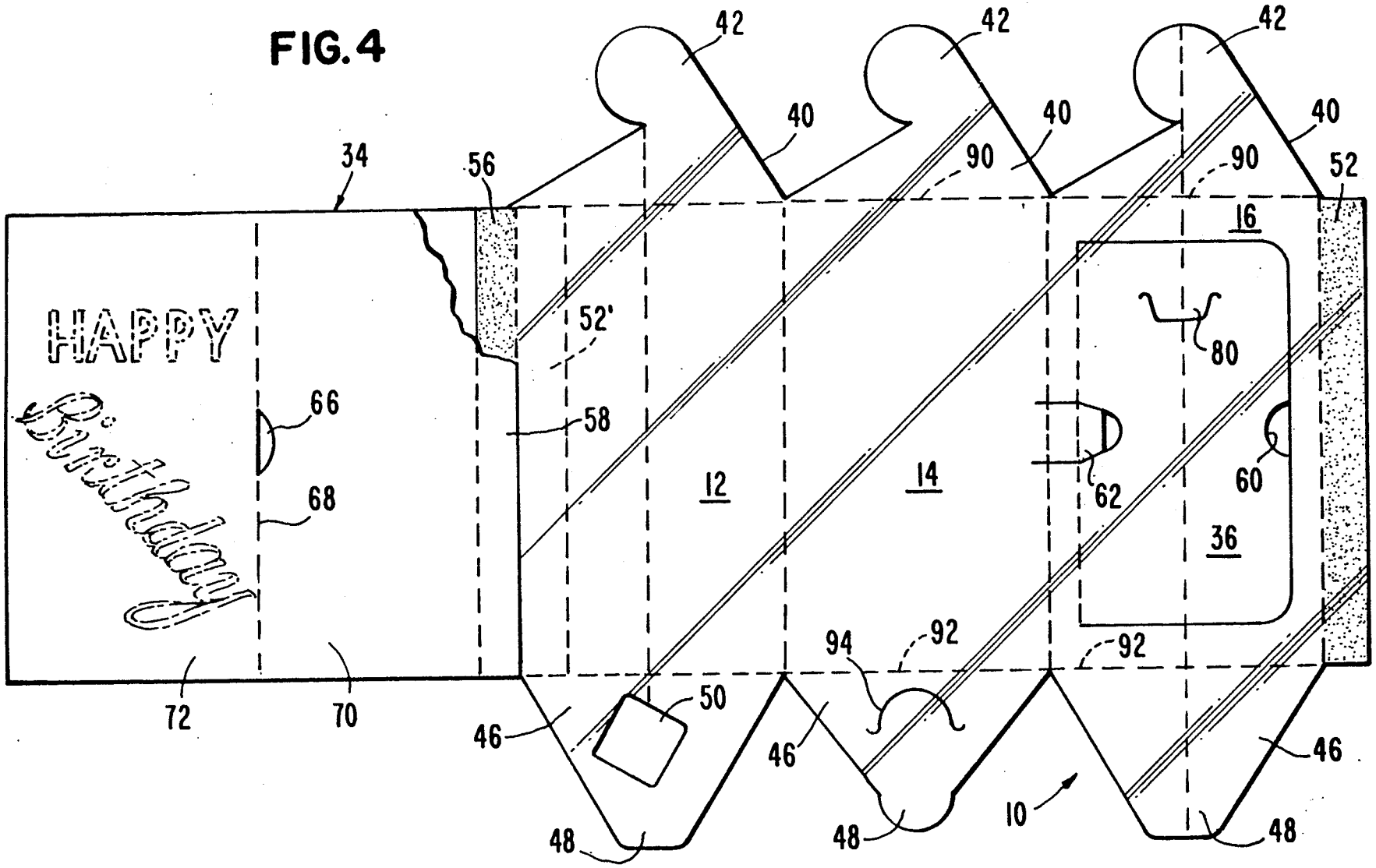
FIG. 4 is a top plan lay-out view showing the shape of the outer container, and the greeting card attached to an end flange of one of the walls of the container.

Referring to FIG. 4, there is illustrated therein a full layout of the outer container 10, including side walls 12, 14 and 16, and the greeting card 34. Flanges to which adhesive can be applied are also illustrated for securing the walls 12, 14 and 16 in the generally triangular cross-sectional shape shown in FIGS. 1 and 2, and for securing the card 34 to a flange provided on the outer edge of the side wall 12 to which adhesive can be similarly applied. With the exception of openings or slits, and the transparent panel 36 which forms part of the back wall 16, each side wall 12, 14 and 16 is similarly constructed, and similar reference numerals will accordingly be applied.

Referring to the back wall 16 against which the greeting card is folded, an upper flange 40 extends outwardly from the main body of the wall, with the flange 40 being generally triangular shaped except for a generally circular projection 42 at the extreme upper end thereof. Similar flanges and projections are formed at the upper ends of the side walls 12 and 14.

Figure 6:
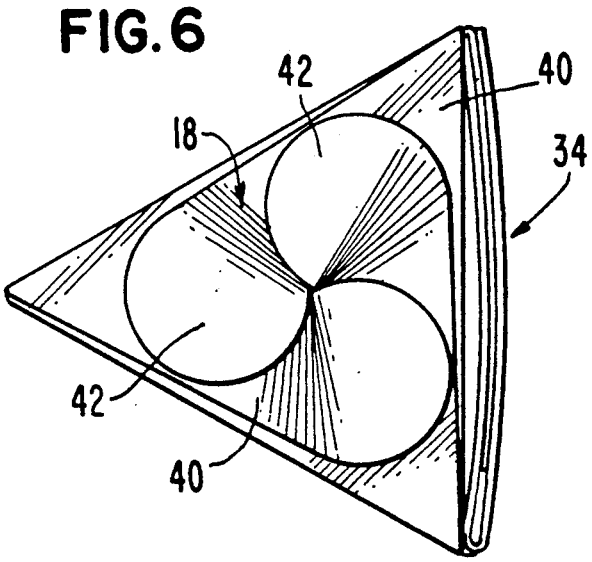
FIG. 6 is a top plan view of the container, showing the manner in which the top wall of the outer container is assembled.

A generally triangular flange 46 projects from the opposite, lower end of the side wall 16, tapering to a blunt lower edge 48. The lower flange 46 formed on the bottom of the side wall 14 is provided with a generally semi-circular projection 48 at the extreme lower end thereof. The lower flange 46 formed on the side wall 12 has a blunt edge 48, similar to edge 48 formed on the flange 46 extending from wall 16. A generally rectangular opening 50 is formed in the flange 46 at the left in FIG. 4, and the interconnection of both the upper flanges 40 and the lower flanges 46 will be described in more detail when particular reference is made to FIGS. 6 and 7.

A side flange 52 extends laterally from the side edge of wall 16, and is provided with an adhesive surface for attachment to the inside surface of the side wall 12 when the walls 12, 14 and 16 are joined. The area on the side wall 12 which the side flange 52 overlays and is connected to is indicated by dash lines 52' in FIG. 4.

A flange 56 extends laterally from the free end of the side wall 12. An adhesive is applied to the side flange 56 as fragmentarily shown in FIG. 4, with an overlying edge 58 of the card 34 being adhesively secured to the flange 56. The card can be adhesively secured as described either prior to or after the folding and joining of the side walls 12, 14 and 16 as shown in FIGS. 1 and 2.

As best shown in FIG. 3, the transparent panel 36 is formed by simply severing the wall at the top, bottom, and one side of the wall, with the uncut side forming a hinge for the panel. The panel is formed with a finger notch 60 along its side edge by means of which it can be grasped by the user to move the panel to its FIG. 3 position. A tab 62 (FIG. 3) is cut out partially from the hinged side of the panel 36 and from slots commonly designated at 64 cut in the side wall 14, thereby permitting the tab to be rotated about an axis extending perpendicularly to the slots 64 and coinciding with the termination of the slots 64 in the side wall 14.

Figure 8:
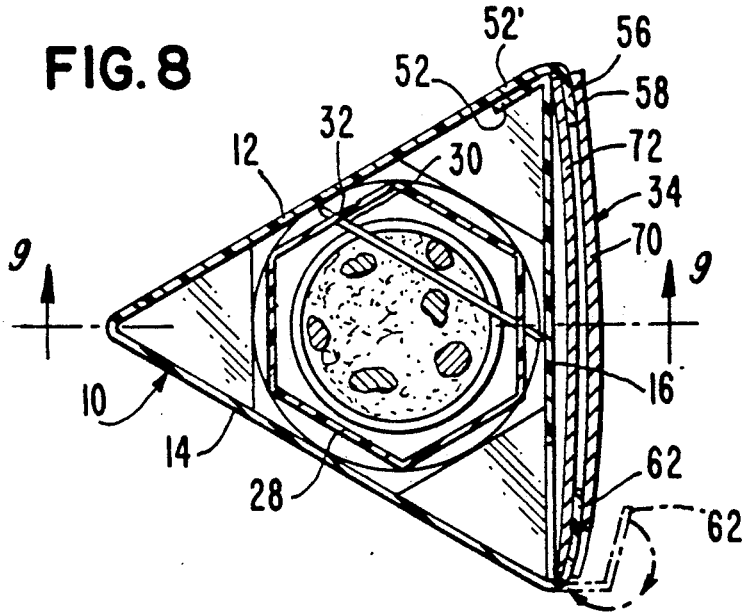
FIG. 8 is a sectional view taken along line 8—8 of FIG. 2, showing more clearly the manner in which the walls of the container are adhesively joined during assembly, and the manner in which the greeting card is mounted on the outer container.

Referring to FIG. 4, the greeting card is formed with a generally semi-elliptical opening 66 the flat edge of which is coincident with the fold line 68 of the sides 70 and 72 of the card. As can be seen in FIG. 8, the tab 62 is adapted to extend through the semi-elliptical opening 66 when halves of the card are first folded together, and then the card rotated about the axis coincident with the edge of the adhesive flange section 56 adjacent to the side wall 12. As noted, the hinging of the tab 62 about an axis in the plane of the side wall 14 permits the tab to be moved entirely out of the plane of the side wall 16 to permit the greeting card 34 to be reversely folded to a position contiguous the side wall. When in such position, the tab 62 is simply inserted through the opening 66 to a locked position as shown in FIG. 8.

FIG. 8 also shows in cross-section the unique bonding arrangement for the outer container and the greeting card. The adhesive-containing flange 52 laterally adjoining the side wall 16 is pressed against and bonded to the wall portion 52' shown in FIG. 4. This retains the side walls in an assembled, triangular configuration. The adhesive-containing flange 56 which laterally adjoins the side wall 12 extends outwardly beyond the container configuration, with the adhesive layer being applied to the outer surface of the flanqe 56, that is, the surface facing away from the interior of the container. The card 34 can then be adhesively secured to the flange 56 by aligning the lateral portion 58 of the card with the flange 56 and pressing these surfaces together. Only the outer surface of the flange 56 is adhesively coated whereby the side 72 of the card can be interposed between the flange 56 and the contiguous surface of the side wall 16, as clearly shown in FIG. 8. Following such bonding of the card to the flange 56, the card can be reversely folded to its FIG. 8 position and the tab 62 inserted through the slot 66. Prior to this, the container and plant, with the transparent sleeve 38, are positioned within the outer container so that the entire assembly is ready for sale.

Figure 5:
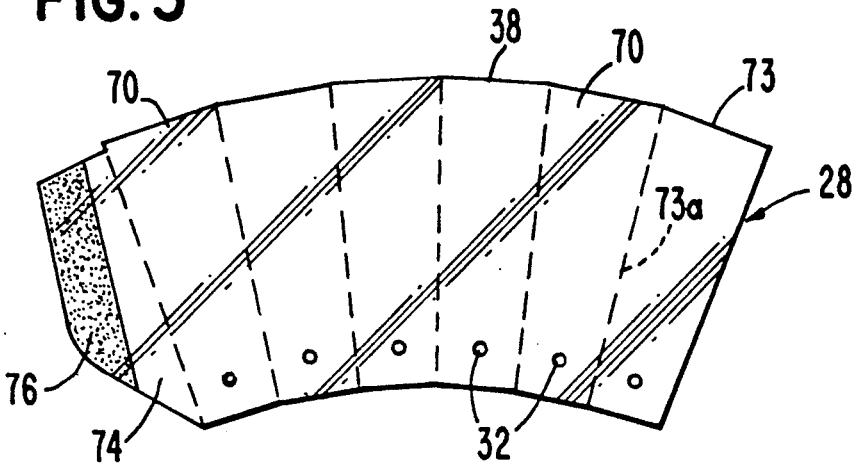
FIG. 5 comprises a lay-out of the transparent sleeve adapted to be positioned around the plant as shown in FIGS. 1 and 2.

Referring to FIG. 5, the sleeve 38 comprises a plurality of similar or identical sections or walls 73 each of which is separated from the adjoining section by a fold line 73*a*. In the form shown, there are six such sections so that the sections, when folded, define a sleeve hexagonal in cross-section. It will be noted that each section is wider at the top periphery thereof, compared to the width of the section at the bottom. This provides an outwardly and upwardly tapered sleeve when the sections are folded and secured, as shown in other drawing figures.

A flange 74 extends laterally from the section 73 shown at the left in FIG. 5, and this flange is provided with an adhesive surface 76. This permits the sleeve to be folded into its hexagonal cross-sectional shape, and the adhesive surface 76 bonded to the opposite surface of the section 73 shown at the right in FIG. 5.

The dimensions of the sleeve are selected so that the smaller bottom portion extends loosely over the top flange of the pot 24 to rest on the top wall of the container 22. The sleeve is upwardly and outwardly tapered to permit the leaves of the plant to be gently lifted and retained by the sleeve without damage to the leaves.

Adjacent the narrow end of each section 73 of the sleeve 38, openings 32 are formed. The purpose of these is to permit the insertion of a pin or the like 30 through adjacent openings 32 as shown in FIGS. 1, 3 and 8. This prevents the pot, and consequently the plant, from moving upwardly relative to the sleeve.

Figure 9:
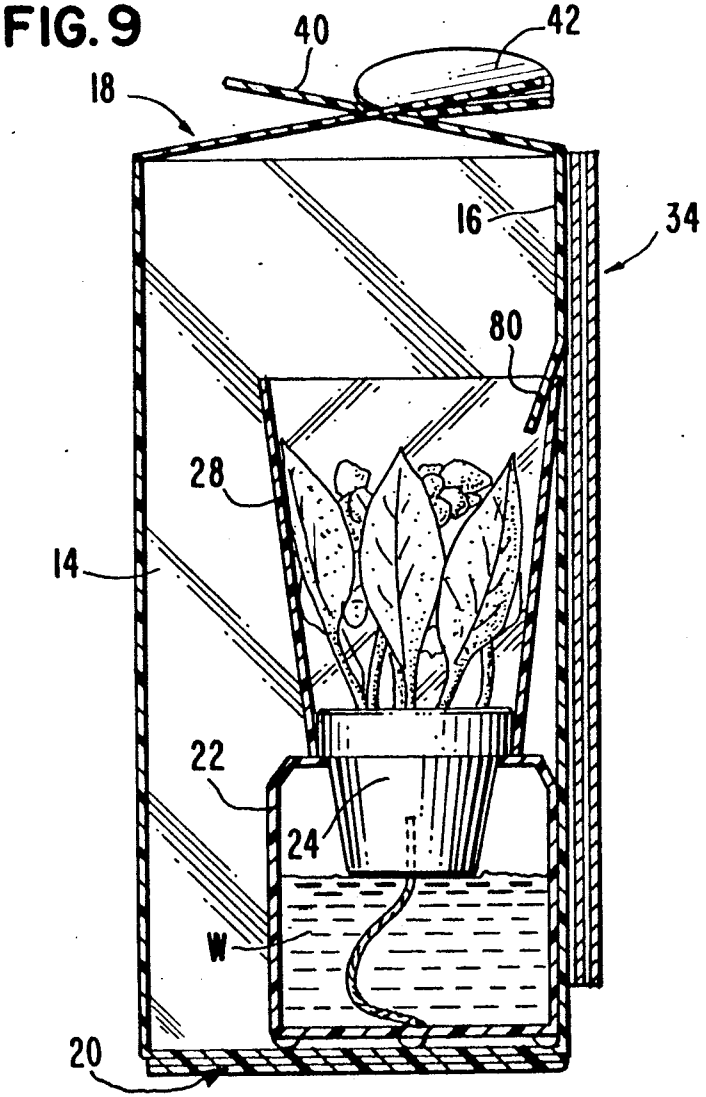
FIG. 9 is a vertical sectional view taken on line 9—9 of FIG. 8.

In order to retain the sleeve in its assembled, FIG. 1 position, the transparent panel 36 formed in the wall 16 is cut near the central upper portion thereof to form a tab 80 (FIG. 4) which is movable inwardly or outwardly relative to the plane of the panel 36. The vertical positioning of the tab 80 is such that its hinge axis is at the level of or slightly above the upper edge of the sleeve 38, as shown in FIG. 9. Thus, when the container and sleeve are positioned adjacent to the rear wall 16, the tab 80 can be positioned over the contiguous portion of a section 73 of the sleeve thereby to prevent the sleeve, and consequently the plant, pot and container, from moving vertically in the outer container. This serves to stabilize the entire assembly, and permits at least a reasonable amount of jostling during handling of the completed assembly without affecting the positioning of the various components as shown in FIGS. 1, 2 and 9.

The top wall 18 of the outer container is formed by folding the flanges 40 toward the center of the outer container after the side walls 12, 14 and 16 have been assembled. The projections 42 can then be interengaged as shown in FIGS. 1, 2 and 9, with the configuration of the tabs and projections being such that a reasonably secure connection is provided. Fold lines commonly designated 90 can be provided at the intersection of the flanges 40 and the associated side walls to bias the flanges toward the center of the outer enclosure to facilitate the interleaving of the tabs and projections, and to provide a reasonably flat upper wall. If desired, access to the plant and container can be achieved through the top wall by opening the flanges 40, without interfering with the assembled card. This might be desirable for replenishing the water supply in the container, as will be hereinafter described.

The bottom wall 20 of the outer container 10 is formed by the interconnection of the flanges 46, with similar pre-fold lines commonly designated at 92 being provided at the intersection of the flanges and the adjoining walls The pre-folding is such that the tabs are biased inwardly toward the center of the enclosure in much the same manner as the upper flanges 40.

Figure 7:
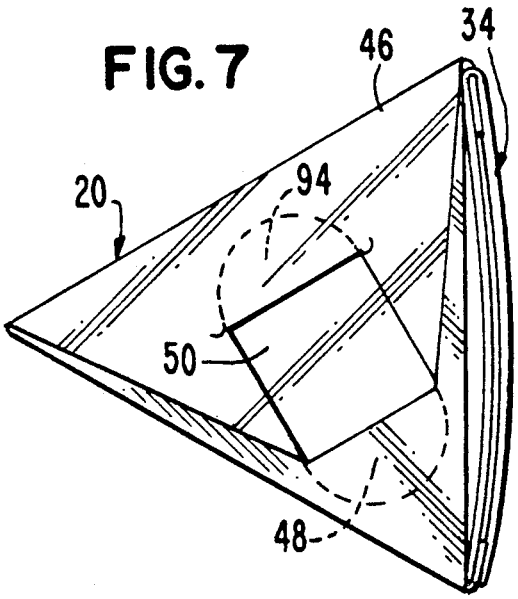
FIG. 7 is a bottom plan view of the container, showing the manner in which the bottom wall of the outer container is assembled.

As previously described, a generally rectangular opening 50 is formed in the flange 46 adjoining the wall 12, and a semi-circular projection 48 is provided at the outer end of the adjoining flange 46. This same flange is also provided with a tab 94 formed by cutting through the flange, with the tab being rotatable about an axis through the ends of the tab, in the same manner as the tab 80 formed in the panel 36 of the wall 16. Both the tab 94 and the projection 48 extend through the opening 50 and are positioned against the undersurface of the flange portions surrounding the opening 50 as shown in FIG. 7.

To assemble the bottom, the flange 46 shown at the right in FIG. 4 is moved inwardly, followed by the flange 46 adjoining the wall 12, with the central flange 46 thereafter being folded inwardly to overlie the flange 46 containing the opening. The position and dimensioning of the opening 50, the tab 94, and the projection 48 are such that when the flanges are folded as described, both the flange and the projection extend on opposite sides of the opening 50. However, both the tab 94 and projection 48 can be easily tucked under the associated edge of the opening 50 so as to extend below the flange on opposite sides of the opening, as shown in dash lines in FIG. 7.

This connection at two locations provides a very secure fitting between the bottom flanges, thereby providing an assembled bottom wall which firmly supports the container, plant and sleeve assembly.

FIG. 9 is a sectional view showing the fully assembled flower greeting card. As previously noted, the container 22 per se forms no part of the present invention and has been shown in detail only to illustrate the novelty and practicality of the present invention. The marketing of plants with other items such as greeting cards, for example, has always posed a problem in view of the need for periodic watering of the material. The container 22 provides self-watering of the plant over a relatively long period of time, thereby providing a substantial shelf duration for the product. This greatly minimizes the care required by the seller, an obviously important consideration from a marketing standpoint. If the assembly is put together by the retailer, the container 22, with the plant removed, can be filled with water to the level of the bottom of the pot, and the card attached to the rear wall 16. The sleeve 28 is then positioned around the plant and the pin 30 inserted. Since the plant is watered through capillary action by a wick suspended downwardly in the water, bottom watering of the plant can continue until the water supply becomes very low. When replenishment is required, the top 18 of the outer container can be opened by disengaging the projections 42 and moving the flanges 40 outwardly so as to provide access to the interior of the enclosure. Following such access, the tab 80 can be lifted so as to free the sleeve 28 from the rear wall 16, and the sleeve, plant and container removed. After the container has been replenished with water, the reverse procedure is followed, with the tab being returned to its FIG. 9 position to retain the sleeve in place.

Figure 10:
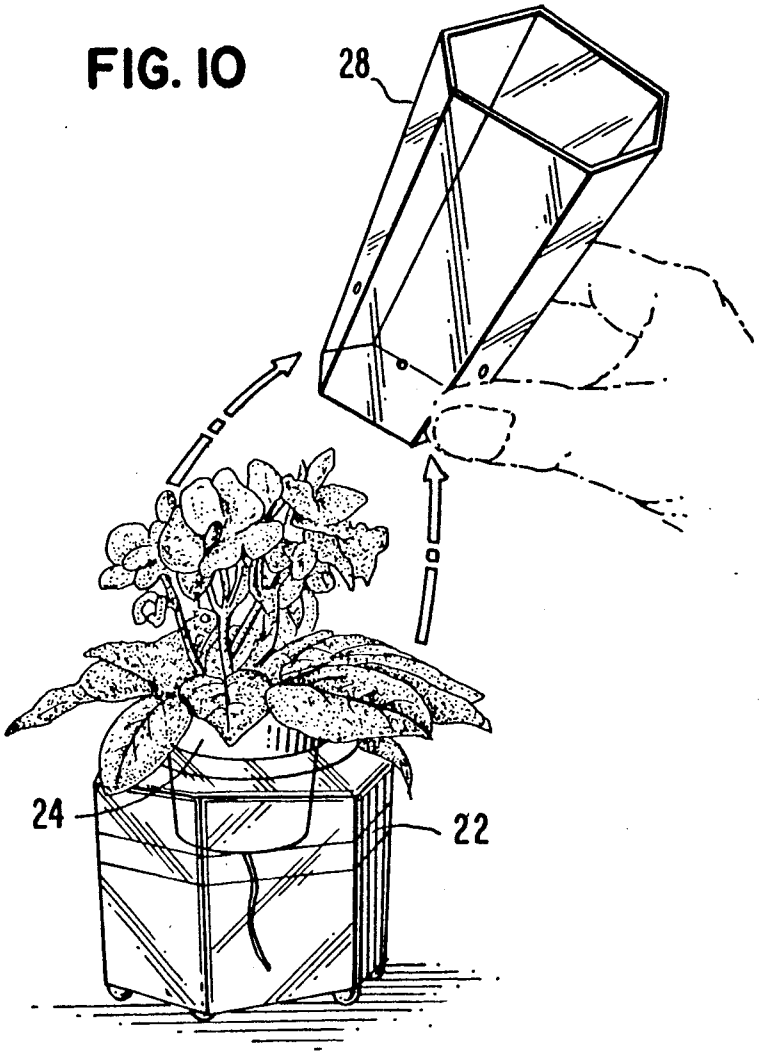
FIG. 10 illustrates the manner in which the sleeve surrounding the plant can be removed by the purchaser to fully expose the plant and its supporting container.

The purchaser of the flower greeting card will normally open the greeting card to read the message on the card panels 70 and 72, at the same time exposing the transparent panel 36. The panel can be rotated outwardly by inserting a finger through the slot 60. Movement of the panel 36 outwardly will automatically serve to disengage the tab 80 from the sleeve 38, thereby freeing the sleeve, container, and plant for removal from the enclosure. When so removed, the pin 30 can be withdrawn from the openings 32, and the sleeve 28 lifted upwardly as shown in FIG. 10. This permits the leaves of the plant to assume their natural position as shown in FIG. 10. As previously described, the dimensions of the sleeve are such that the leaves are not damaged during shipment or handling, and the raising of the leaves so as to be enveloped by the sleeve serves the additional function of protecting the flowers of the plant.

The greeting card can be removed from the wall 16 if desired by a light pulling action where the section 58 of the card panel 70 is adhesively secured to the flange 56 laterally adjoining the panel 12. The recipient thus receives both an appropriate greeting card and a healthy and highly attractive plant. After the container and plant have been removed and the card severed from the rear wall 16, the outer container and the sleeve, are normally discarded unless further handling is anticipated. In such event, the outer enclosure can be used again since the bottom wall and interconnection of the side walls remain intact when the card is separated and the plant is removed.

It will be appreciated that the flower greeting card described is particularly adaptable to miniaturized plants of the type shown and described. In the embodiment illustrated, the total height of the outer container is 6"–7", and the width of each wall 12, 14 or 16 approximately 3 ½". Thus, minimal shelf space is required. Moreover, due to the transparency, the complete assembly can be displayed so that the front of the card is readily visible, thereby permitting the buyer to pick a card with an appropriate message. Alternatively, the outer container with contents can be displayed without the card so that a card with the desired greeting can be purchased at the site. A separate display stand offering numerous greeting cards for various occasions could be displayed adjacent the displayed containers to provide a wide selection of personal messages. A further possibility is to provide a printed message only on the front panel of the card contiguous the wall 16, with the inside of the card being left blank for the purchaser to write in a special message to the ultimate recipient. The marketing flexibility provided by the invention will be readily apparent.

What is claimed is:

1. A greeting card assembly adapted to receive and support a decorative plant, comprising:

a) a foldable greeting card, b) transparent side walls through which the decorative plant can be observed, said side walls having adjoining edges which are interconnected;

c) a transparent back panel connected at one side thereof to one of said side walls positioned adjacently thereto, said back panel including a hinged panel which can be opened when the card has been unfolded away from the back panel thereby providing access to the interior of the assembly;

d) said greeting card being secured along a side edge thereof to one of said side walls and adapted, when folded, to be positioned behind said back panel and viewable therethrough from the front of the assembly;

e) means for releasably retaining said greeting card in the folded position;

f) bottom flanges extending from said side walls and said back panel and formed with connecting means by means of which said bottom flanges can be releasably interconnected when said side walls and said back panel are assembled, said bottom flanges thereby collectively forming a bottom wall for the assembly, and g) top flanges extending from said side walls and back panel, said top flanges being constructed so as to releasably interengage when said side walls and said back panel are assembled, subsequent disengagement of said top flanges permitting access to the interior of said assembly from the top thereof.

2. The greeting card assembly of claim 1, wherein said means for releasably retaining said greeting card comprises an opening formed in said greeting card adjacent the side edge thereof when said greeting card is folded, and a tab provided on an adjacently disposed side wall, said opening when said greeting card is folded behind said back panel receiving said tab to maintain the greeting card in such folded position, with subsequent release of said tab permitting the greeting card to be unfolded.

3. The greeting card assembly of claim 1, wherein said top flanges comprise substantially circular projections at the outer ends thereof, which projections are adapted to interleave when said flanges are folded one upon the other thereby to provide a releasable top wall.

4. The greeting card assembly of claim 1, wherein said bottom flanges are each generally triangular in shape, with one of said flanges being formed with a generally rectangular opening, and an adjoining flange being formed with a semicircular leading end, said semicircular leading end being positioned through said opening when said bottom flanges are positioned one upon the other when the assembly is folded thereby retaining said bottom flanges in place to form said bottom wall.

5. The greeting card assembly of claim 1, wherein said hinged panel of said back panel comprises a substantial portion thereof, said hinged panel being hinged along a longitudinal side thereof and being otherwise separate from said back panel so as to be movable away from the plane of said back panel about an axis through the hinged connection, said hinged panel being provided with a tab opening opposite the hinged connection to facilitate opening the hinged panel, a second opening adjacent the hinged axis for receiving a tab extending from the adjacently disposed side wall, and a top tab on said hinged panel adjacent the top flange of said back panel, said top tab being movable inwardly following assembly to engage and retain plant material positioned within said assembly.

6. The greeting card assembly of claim 1, further including a side flange extending from the free end of the back panel prior to assembly, said side flange having an adhesive backing by means of which the flange can engage a corresponding area formed on the adjacent surface of one of said side walls when said side walls and back panel are assembled thereby to permanently secure said side walls and back wall together.

7. The greeting card assembly of claim 6, wherein the side wall to which said side flange of said back panel is secured is also formed with a laterally extending, adhesively coated side flange which is adapted to receive and secure an overlying surface of said greeting card, such area of adhesive engagement serving as a hinge around which the greeting card can be unfolded and moved outwardly away from said back panel.

8. The greeting card of claim 1, in combination with plant material and supporting means therefor adapted to be positioned interiorally of the greeting card assembly, comprising:

a) a potted plant;

b) container means for supporting the pot in a generally vertically intermediate position within the assembly;

c) sleeve means positioned around the leaves and flowers of the plant, and d) means for retaining said potted plant and said container in said assembly.

9. The combination of claim 8, wherein said container means comprises upper and lower container sections, the lower section adapted to contain a reservoir of water from which the plant can be watered, and a wick extending from the bottom of the pot toward the bottom of the container whereby the plant can be watered by capillary action.

10. The combination of claim 8, wherein said sleeve means comprises an elongated section of transparent material, said section being divided into fold lines by means of which the section can be folded into a multi-walled sleeve which is smaller in diameter at the bottom thereof than at the top, with the bottom of said sleeve positioned around said pot, and means for preventing upward movement of said pot relative to said sleeve.

11. The combination of claim 10, wherein said means for preventing upward movement of said pot comprises a pin which extends through openings formed in the walls of the sleeve, with the pin extending over at least part of the top edge of the pot so as to prevent upward movement of the pot.

12. The combination of claim 8, wherein said retaining means comprises a tab formed in and extending from a hinged panel forming part of said transparent back panel, said tab extending downwardly over the upper edge of said sleeve thereby preventing upward movement of said sleeve, and thus said container and said pot.

13. The combination of claim 8, wherein said back panel is formed with a hinged panel which, when said greeting card is unfolded, can be opened outwardly away from the interior of the assembly to provide ingress and egress of said container, pot, and sleeve, thereby facilitating the initial positioning of said container, pot, and sleeve within the greeting card assembly, and removal of the same as necessary to replenish the supply of water in the container.

* * * * *